US005566564A

United States Patent [19]

Brauer

[11] Patent Number: 5,566,564

[45] Date of Patent: Oct. 22, 1996

[54] ROLLING BLOCK FOR ROLLING METALLIC BARS OR WIRES

[75] Inventor: Hans Brauer, Leichlingen, Germany

[73] Assignee: Kocks Technik GmbH & Co., Hilden, Germany

[21] Appl. No.: 214,832

[22] Filed: Mar. 17, 1994

[30] Foreign Application Priority Data

Mar. 17, 1993 [DE] Germany ..... 43 08 449.4

[51] Int. Cl.[6] ..... B21B 13/10; B21B 39/00; B21B 31/00

[52] U.S. Cl. ..... 72/226; 72/224; 72/238; 72/237

[58] Field of Search ..... 72/224, 235, 237, 72/249, 226, 238

[56] References Cited

U.S. PATENT DOCUMENTS

| | | | |
|---|---|---|---|
| 1,762,293 | 6/1930 | George et al. | 72/235 |
| 2,002,266 | 5/1935 | Kral | 72/235 |
| 3,595,055 | 7/1971 | Rohde | 72/226 |
| 3,952,570 | 4/1976 | Demny et al. | 72/224 |
| 4,044,586 | 8/1977 | Properzi | 72/224 |

FOREIGN PATENT DOCUMENTS 3445219 2/1987 Germany .

*Primary Examiner*—Lowell A. Larson
*Assistant Examiner*—R. A. Butler
*Attorney, Agent, or Firm*—Michael J. Striker

[57] ABSTRACT

A rolling block for rolling metallic bars or wires, has a plurality of rolling frames arranged on successive frame spots and each having three rollers arranged in a star-like manner and radially adjustable with respect to a longitudinal axis of a rolling product, a drive for driving the rollers and including separately regulatable motors, the rolling frames including less rolling frames than the frame spots, a first one of the rolling frames which is provided with a drawing pass being located at a first frame spot provided at an inlet side and having a separate front one of the motors, all of the rolling frames provided with finishing passes being located at last frame spots at an outlet side and driven by at least one rear motor, and all remaining rolling frames provided with drawing passes being located at frame spots which immediately follow the first frame spots or at frame spots immediately preceding the rolling frames with finishing passes and driven jointly by at least one central motor.

22 Claims, 6 Drawing Sheets

1
2
3
4
5
6
7
8
X
Q [%] = 0/20 0/20 20 20 20 20 20 20 20 3/10 1/5 1

1
2
3
4
5
6
7
8
9
10
X
Q [%] = 0/20 0/20 20 20 20 20 20 20 3/10 1/5 1

| Rolling frame | Initial ϕ 79,5 mm | | | |
|---|---|---|---|---|
| 1 | 0 bis 20 | 0 bis 20 | 0 bis 20 | 0 bis 20 |
| 2 | 0 bis 20 | 0 bis 20 | 0 bis 20 | 0 bis 20 |
| 3 | 20 | 20 | 20 | — |
| 4 | 20 | 20 | 20 | — |
| 5 | 20 | 20 | — | — |
| 6 | 20 | 20 | — | — |
| 7 | 20 | — | — | — |
| 8 | 20 | — | — | — |
| 9 | 10 | 10 | 10 | 10 |
| 10 | 5 | 5 | 5 | 5 |
| Final ϕ [mm] | 30 – 37,5 | 37,5 – 46,8 | 46,8 – 58,6 | 58,6 – 73,2 |

| Rolling frame | Initial ϕ 79,5 mm | | | |
|---|---|---|---|---|
| 1 | 0 bis 20 | 0 bis 20 | 0 bis 20 | 0 bis 20 |
| 2 | 0 bis 20 | — | — | — |
| 3 | 20 | — | — | — |
| 4 | 20 | 0 bis 20 | — | — |
| 5 | 20 | 20 | — | — |
| 6 | 20 | 20 | 0 bis 20 | — |
| 7 | 20 | 20 | 20 | — |
| 8 | 20 | 20 | 20 | 0 bis 20 |
| 9 | 10 | 10 | 10 | 10 |
| 10 | 5 | 5 | 5 | 5 |
| Final ϕ [mm] | 30 – 37,5 | 37,5 – 46,8 | 46,8 – 58,6 | 58,6 – 73,2 |

| Rolling frame | Initial ∅34,5 mm | | | | |
|---|---|---|---|---|---|
| 1 | ① 11,6 | ① 11,6 | ① 11,6 | ① 11,6 | — |
| 2 | ② 11,6 | ② 11,6 | ② 11,6 | ② 11,6 | — |
| 3 | ③ 13,1 | ③ 13,1 | ③ 13,1 | — | — |
| 4 | ④ 13,1 | ④ 13,1 | ④ 13,1 | — | — |
| 5 | ⑤ 15 | ⑤ 15 | — | — | — |
| 6 | ⑥ 15 | ⑥ 15 | — | — | — |
| 7 | ⑦ 17,8 | — | — | — | — |
| 8 | ⑧ 17,8 | — | — | — | — |
| 9 | ⑨ 21,7 bis 0 | ⑦ 17,8 bis 0 | ⑤ 15,0 bis 0 | ③ 13,1 bis 0 | ① 11,6 bis 0 |
| 10 | ⑩ 21,7 bis 0 | ⑧ 17,8 bis 0 | ⑥ 15,0 bis 0 | ④ 13,1 bis 0 | ② 11,6 bis 0 |
| ∅ [mm] | 14,5 – 18,5 | 18,5 – 22,5 | 22,5 – 26,5 | 26,5 – 30,5 | 30,5 – 34,5 |

ROLLING BLOCK FOR ROLLING METALLIC BARS OR WIRES

BACKGROUND OF THE INVENTION

The present invention relates to a rolling block for rolling metallic bars or wires. More particularly, it relates to a rolling block having a number of rolling frames arranged at successive frame spots and each provided with three rollers arranged in star-like fashion and displaceable radially to a longitudinal axis of the rolling product, and separate regulatable motors for driving the rollers of the rolling block and all roller frames with finishing passes are always located at the last frame spots at the outlet side and are driven there by at least one rear motor.

In a known rolling block of this type which is disclosed, for example, in the German patent DE-PS 34 45 219, all drawing passes at the inlet side are driven jointly by a first motor while both finishing passes at the outlet side are driven respectively by a second or a third motor. Drawing passes are the passes which are arranged at the front and central frame spots of the rolling block and in which a great cross-section reduction of the rolling product is performed or can be performed. In contrast, the finishing passes are the passes which provide the desired final cross-section and the desired final dimensions of the rolling product at the outlet side frame spots and therefore deal with a relatively smaller cross-section reduction. Moreover, a construction is known in which the last finishing pass at the outlet side is driven by the second motor and both subsequent finishing passes are driven jointly by the third motor, wherein to the contrary the substantially greater number of the drawing passes are driven at the inlet side jointly by the first motor than in the previously described construction.

These known constructions have some disadvantages. During production of a substantially greater or smaller final cross-section from the same starting cross-section, or in other words always when the total cross-section reduction of the rolling block must be substantially changed and as a result in the rolling block another number of the drawing passes and rolling frames are required, one can fail to do it only at the first frame spots at the inlet side. The last frame spots at the outlet side must be provided with the rolling frames in the known constructions. The reason is that only these last frame spots are driven by the second or third motor and as a result only there the ratio of the roller rotary speeds of the neighboring rolling frames is steplessly changeable by the separate regulatable motors. The latter is required when it is necessary to change the cross-section reduction of the rolling product so that the final cross-section with all intermediate sizes can be produced. With a predetermined starting cross-section which must be maintained, it is necessary during a conversion, for example, to a substantially greater final cross-section, to use several previously utilized front drawing passes but not longer to use for example the last previously used drawing pass. Therefore it is removed with its rolling frame from the rolling block, in order to provide in the subsequent finishing caliber, which is greater due to the exchange, a greater rolling product cross-section corresponding to it. The released frame spot must be now provided with the drawing pass, which before preceded the last drawing pass and now becomes the last drawing pass. In other words, the associated rolling frame must be offset by one frame spot to the outlet side and also turned by 180° around its drive axis, so that its roller gaps between the rollers are not arranged at the same peripheral portion of the rolling product as the roller gaps of the subsequent first finishing pass. This must be done with all other preceding and further used drawing calibers and their rolling frames, since fixed and uniform transmission ratios are provided between the drive shafts of the front and central frame spots, so that between the remaining drawing passes no frame spots can be released. Otherwise, the drive rotary speeds for both rolling frames before and after the released frame spot are not determined relative to one another. In this manner a substantial labor and time consumption is needed during a conversion of the rolling block to substantially greater or smaller final dimensions, when at least one redundant drawing pass or rolling frame is removed or an additional one must be introduced and all preceding drawing passes are offset by at least one spot.

SUMMARY OF THE INVENTION

Accordingly, it is an object of the present invention to provide a rolling block with passes formed of at least three rollers for rolling metallic bars and wires, which eliminates the disadvantages of the prior art.

More particularly, it is an object of the present invention to provide a rolling block, in which the expenses for converting to another, substantially greater or smaller cross-section size of the rolling product to be produced are substantially smaller than in conventional rolling blocks, and in which the initial inlet cross-section of the first available rolling frame can remain the same and despite this all cross-sectional sizes located within the total withdrawal region of the rolling block can be produced.

In keeping with these objects and with others which will become apparent hereinafter, one feature of the present invention resides, briefly stated, in a rolling block for rolling with several rolling frames as frame spots, wherein the first rolling frame at the inlet side which has a drawing pass is always located at the first frame spot at the inlet side and provided with a separate front motor, and all remaining rolling frames provided with drawing passes are arranged at the frame spots immediately following the first frame spot or at the frame spots immediately preceding the roller frames with the finishing passes and are driven by at least one central motor wherein the cross-section reduction of the rolling product in two passes is steplessly adjustable between zero and a maximum percentage value.

When the rolling block is designed in accordance with the present invention, then during a conversion to another finishing cross-section, the required rolling frames with drawing calibers can remain at their frame spot and must not be either converted or turned with a substantial simplification of the conversion of the rolling block, and the number of the rolling frames required as a whole and thereby the investment and operational costs are substantially reduced.

Only superfluous rolling frames with drawing calibers must be removed or several failing rolling frames of this type can be inserted. The first frame spot at the inlet side with the first drawing pass and the frame spot at the outlet side with the finishing passes remain always in the rolling block. Only the rollers of the finishing passes with their pass openings must be changed during each change of the final size. This can be performed by post working, radial adjustment and/or exchanging of the rollers. In the region of the inserted or remaining drawing passes, a radial adjustment of the rollers is sufficient when a change is required. It is therefore possible, without preparing of further frames and without working of further pass openings, to roll all final cross-sections with only one set of roller frames of only one initial cross-section of the rolling product uninterrupted gaps, which cross-sections are in the size region of the rolling block. Finally, the inventive rolling block is converted to another final cross-section East and with low expenses. Therefore, in correspondence with the customer's wish, the different final cross-sections can be rolled in any sequence efficiently for small rolling product quantities.

These advantages are achieved since in the inventive rolling block the roller rotary speeds of the first drawing caliber at the inlet side on the first frame spot can be regulated independently from the rollers of the subsequent drawing passes. This is because the first rolling frame on the first frame spot is driven by a separate motor, and the rollers of the second drawing rolling frame together with the roller of the subsequent rolling frame with drawing passes are driven by another also separately regulated motor, so that the rotary speed ratio between the roller of the first rolling frame and the second drawing roller frame can be changed within a great region. In this manner and due to the radial adjustability of the rollers, it is possible to change the cross-section reduction in the first and second roller frames in a great region. This provides for Uninterrupted production of all desired final cross-sections between the maximum and minimum of the final cross-section of the roller block, and for each purpose only a single initial cross-section is required. This simplifies and cheapens the productions oft he starting material. Moreover, for great changes of the final cross-section, conversions in the device before the rolling block are avoided.

In the both first rolling frames with drawing calibers the cross-section reduction can be adjusted from zero to a: maximum value. The maximum value is substantially between 18 and 25 percent. It is dependent on the cross-sectional shape of the pass opening, the radial adjustability of the rollers, the loading of the roller frame, as well as the temperature and the properties of the rolling product. When this parameter can be, for example, a maximum cross-section reduction of 20 percent, then the rolling product is rolled also for the subsequent generally identically formed drawing passes. For maintaining the number of the drawing passes and thereby the rolling frames of the rolling block as low as possible within a desired region of final cross-sections, the rolling frames with the drawing calibers are used as much as possible. In other words, many of them operate with the maximum cross-section reduction of, for example 20 percent. The roller rotary speeds are determined on the frame spots for drawing passes with the exception of the first frame spot, and thereby the rotary speed ratios between the drive shafts of the neighboring frame spots are determined by fixed toothed wheel ratios within the main driving transmission. When it is necessary to produce a greater final cross-section, for which purpose no longer all drawing passes are needed, roller frames are removed so as to reduce the total cross-section reduction of the rolling block by, for example, 20 percent reduction per rolling frame. Since it is desired to avoid rolling errors and obtain a final rolling product with perfect surface, care should be taken that all roller gaps between the rollers of one pass be not located on the same peripheral portion of the rolling product as the roller gaps of the preceding pass.

The same is also true when only one rolling frame or odd number of rolling frames are removed. For avoiding this situation in known constructions, as described hereinabove, after the removal of, for example, one rolling frame, the remaining rolling frames must also be displaced to another frame spot and also turned. In accordance with the present invention, it is possible to remove at least two or an even number of the rolling frames with drawing calibers or to insert the same, and therefore to solve the above identified problem. This is possible in the inventive rolling block since the first pass at the inlet side is separate or, in other words, is driven separately regulatably, and the second drawing pass is also regulatable separately by another motor, whereby this separate rotary speed regulation is obtained with other means. Finally, in accordance with the present invention, at the inlet side both in the first drawing pass and the second drawing pass, the cross-section reduction can be steplessly adjusted between zero and the maximum value for example 20 percent. This is performed by a respective radial adjustment of the rollers to the rolling product longitudinal axis and a corresponding adjustment of the roller rotary speeds. Since in the both first drawing calibers the cross-section reduction is regulatable steplessly between zero and the maximum value, the drawing passes can be removed or inserted in pairs, with maintaining an uninterrupted row of final cross-sections. Thereby the conversion of the remaining drawing passes and a turning of their rolling frames are avoided.

When the rolling block is formed in accordance with the present invention, the total drawing degree of the drawing block is adjusted substantially in the region of both drawing passes. After the stepped course adjustment by removal or insertion of roller frames or drawing passes, intermediate values are to be adjusted in a stepless manner for uninterrupted adjustment of finishing passes. No changes of the initial cross-section are therefore needed. Also, for an exchange of the material to be rolled to a substantially different width ratio, regulation can be performed in the region of the both first drawing passes by changing the roller rotary speed and/or the roller position. With such a regulation it is possible to withdraw from the last drawing pass exactly such rolling product cross-section, which is proper for the following finishing pass, for maintaining small wear of the finishing caliber and providing especially narrow size tolerances as well as the desired cross-sectional shape with a sufficient surface quality in a finished rolling product. The known switching transmission steps for driving of the last drawing pass can be therefore dispensed with.

It is recommended to change the cross-section reduction of the rolling products only in the both first passes at the inlet side and steplessly between zero and a maximum percentage value, while in all remaining drawing passes it is constant. This does not mean that the cross-section reduction in them must have identical values. It is however advisable when the cross-section reductions in the remaining drawing passes are identical and correspond to the maximum value. A regulation of the cross-section reduction can start in the both first drawing passes and then proceed on the remaining rolling frame spots with drawing passes. This saves multiple expenses since otherwise this can be performed by variable rotary speed ratios between the frame spots. Fixed toothed wheel ratios can be therefore provided in the main transmission for the rolling frames with drawing passes driven by the central motor. Moreover, during rolling with a reduced number of rolling frames with drawing passes, always an even number of neighboring drawing passes must be dismounted.

It is advantageous when the drawing passes are formed by rollers with cylindrical working surfaces. Such passes are identified also as flat passes. Thereby triangular pass openings are produced by respective three rollers per drawing caliber. It is advantageous that the roller can be displaced radially by a substantial value without changing the desired triangular or hexagonal cross-sectional shape of the drawing product, not taking the dimensions into account. For the total dimension region of the rolling block, always the same rolling frames and rollers are utilized on the frame spots with drawing passes, when they are not removed for greater final dimensions. Then it is however sufficient, without converting the rolling frames, to displace the rollers of these drawing passes radially, by adjusting devices and corresponding indicators of the platform.

Moreover, it is also possible that the drawing passes are composed of rollers with working surfaces having a concavely curved cross-section, and the pass openings are alternatingly oval and round. The so-Called oval pass openings do not impart efficient oval cross-sectional shape to the rolling product and they are not actually oval in literal as well as geometrical sense. They have a cross-sectional shape which is similar to a triangle, but the triangle sides are concavely curved and thereby are similar to the arcs of an oval.

During rolling of bars and wires having a round cross-section it is recommended to form the working surfaces of the rollers with a concavely curved cross-section so that in the first finishing pass the working surfaces of the rollers are maximum 0.63 times and in the subsequent finishing pass or passes they are maximum 0.55 times the final diameter. For finishing rollers of round cross-sections, at least two round passes must be used at the outlet side of the last frame spots with shapes and dimensions which are very close to the final rounds. The actual cross-sectional reductions of the finishing caliber automatically adjust to the variations of the inlet cross-section surface. It amounts to approximately ±2 percent, so that the pulling ratio in the rolling product cross-section before and between the finishing passes changes and thereby also the effective roller diameter of the finishing pass. Due to this automatic compensation it is possible, after a change of the final dimensions or after changes of the rolling product material, to obtain the desired final dimensions with the narrowest tolerances and best surface without test rolling.

It is advantageous when a third additional finishing pass with a calculated cross-section reduction of approximately 1 percent is arranged behind the last-frame spot at the outlet side. With this additional third finishing pass, especially narrow tolerances with fine surfaces can be obtained.

It is further advantageous when the drive for the second and in some cases third finishing pass has a free running coupling, which permits a high through speed of the rolling product. This however is important only for great finishing cross-sections. The outlet speed and the cross-sectional surface of the rolling product exiting the first finishing pass determine the cross-section reduction and thereby the roller rotary speed of the second and in some cases the third finishing pass. Without the rolling product, the rollers of the second and in some cases third finishing pass rotate with the rotary speed of the first finishing pass. Due to smaller final dimensions, the free running coupling must be selectively turnable on and off. Finally, the frame spots for the finishing passes can be provided with separate motors.

In accordance with a further embodiment of the invention, a switching transmission step with at least two speeds can be arranged between the rear motor and the finishing pass driven by it. In this manner it is insured that the rear motor can produce all roller rotary speeds required in the region of the finishing passes and this motor can operate in the rotary speed region which is favorable for it.

The objective of the present invention can be achieved in another similar manner. This another solution is necessary for example in a rolling block with a drive such as in the known prior art, in which all drawing passes at the inlet side are jointly driven by the first motor and the both finishing passes at the outlet side are driven respectively by separate second and third motors. For this second solution it is not important whether both last rolling passes are formed as finishing passes or not. Thereby the second solution can be used in such rolling blocks which operate in a rolling device as a preceding block or an intermediate block. In such rolling blocks the expenses for the conversion to another substantially greater or smaller final dimension of the rolling product are substantially reduced. The second solution of the present invention resides in that, during rolling with less rolling frame as spots, all remaining eventually inserted rolling frames are arranged on the first frame spots at the inlet side directly one after the other and the rollers of their passes are driven by at least one separate front motor wherein the cross-section reduction of the rolling product in two passes is steplessly adjustable between zero and a maximum percentage value. Due to the preceding construction, during rolling with less rolling frames than available frame spots, the free frame spots are located between the preceding frame spots and the frame spots at the inlet side which are provided with rolling frames. Also here the number of the free frame spots is adjusted to the size of the starting cross-section and the desired outlet cross-section.

Also here during a conversion to another outlet cross-section, the required roller frames remain as a rule on their frame spots and must not be either converted or turned. Only when the adjustability of the rollers of the rolling frames on the last frame spots at both outlet sides during the conversion for example to a substantially greater, outlet cross-sectional surface of the rolling product is used up, then the rolling frames or passes at the both last frame spots at the outlet side are removed and replaced by the both rearmost remaining rolling frames or passes of the front frame spots, or in other words by those which are located the closest to the penultimate frame spot. Thereby the frame spots before the penultimate frame spot remain free and the free spots at the inlet side are provided with the remaining further required rolling frames. After the removal of the excessive rolling frames, maximum two rolling frames must be replaced on another frame spot, and in each case the complicated turning of the rolling frames is dispensed with. Moreover, only the rollers of the both last passes must be radially adjusted, while all passes remain non-changed as long as the initial cross-section of the first pass at the inlet pass remains the same, It is especially advantageous when the cross-section reduction of the rolling product is changeable only in the both last passes at the outlet side steplessly between zero and a maximum percentage value, while in all remaining passes it remains constant. Constant cross-section reductions do not mean that all the cross-section reductions must be the same. It is recommended, however, that the cross-section reductions in the remaining passes are selected equal and corresponding to the maximum value. This simplifies the structural design of the main drive and reduces the number of the required rolling frames and frame spots. Since in this solution also the cross-section reductions of the rolling product are performed only in two passes, in this case however in both last passes at the outlet side, steplessly between zero and a maximum percentage value, therefore in accordance with a further feature of the invention fixed toothed wheel ratios can be provided in the main transmission for the rolling frames driven by the front motor. It is possible to produce uninterruptedly all outlet cross-sections located in the working region of the rolling block.

Also, in the second inventive solution it is recommended during rolling with a reduced number of rolling frames or passes, to remove always an number of even neigh boring passes, to completely dispense with the expensive and complicated turning of the rolling frames during conversion to another dimension region. Moreover, it is also advisable to use all rollers with cylindrical working surfaces and therefore they can be radially adjusted by a considerable value.

In both solutions it is advantageous when all rolling frames are identical with respect to their structural design. Then each rolling frame on each frame spot can be inserted, which reduces the number of the total provided rolling frames.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
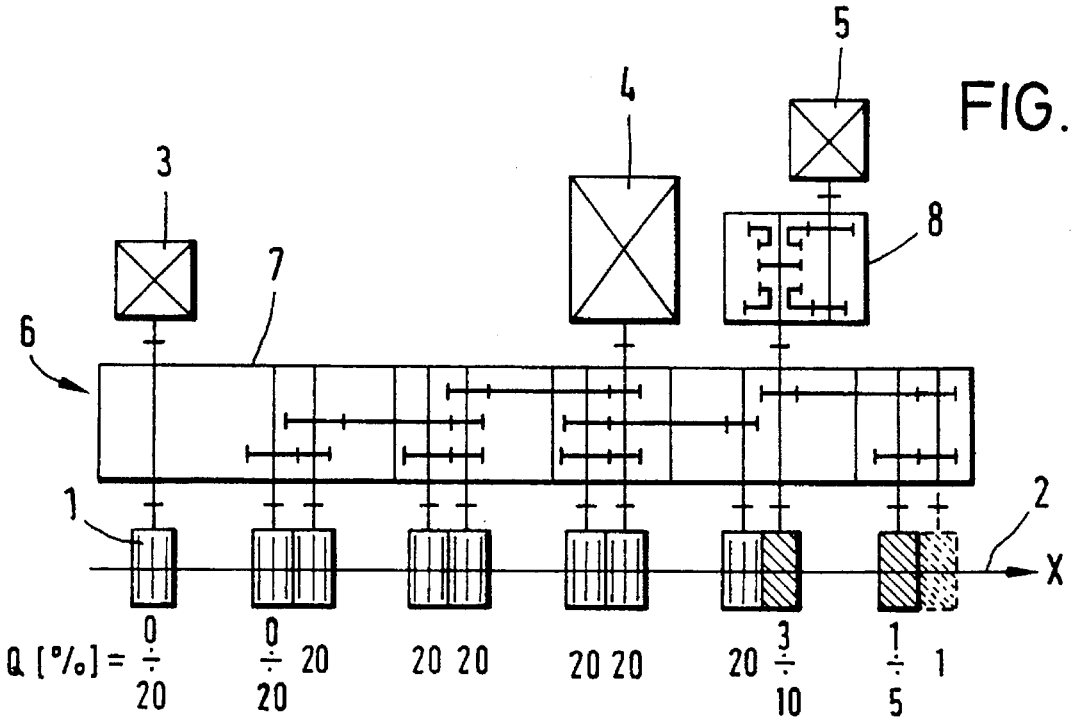
FIG. 1 is a schematic view of a rolling block for rolling of wires in accordance with the present invention.

FIG. 1 shows a plurality of rolling frames 1 in form of rectangles, as well as a rolling product 2 which is transported through the rolling frames 1 in the direction of the arrow "X" so that its cross-section is reduced. The rollers which are not shown in FIG. 1 are driven by three motors 3, 4, and 5 with the use of a main transmission 6. The transmission includes a row of gear wheel transmission steps located in a transmission housing 7 and distributing rotary speeds produced by the motors 4 and 5 to almost all rolling frames 1.

The first rolling frame 1 at the inlet side is driven by the motor 3 which does not drive any further rolling frames 1 and is separately regulatable with respect to its rotary speeds. The second to eighth roller frames 1 form a group which is jointly driven by the motor 4 which is also separately regulatable with respect to its rotary speeds. Since the rotary movement of the motor 4 is transmitted through fixed toothed wheel transmission steps to the rollers of the rolling frames 1 driven by it, the ratio of the roller rotary speeds of the neighboring rolling frames 1 in the region of these rolling frame groups is not changeable. The transmission ratios of the individual toothed wheel transmission steps are selected so that the roller rotary speed of the third to eighth rolling frames 1 correspond to a cross-section reduction Q of the rolling product 2 which is their maximum possible. This maximum cross-section reduction Q in the preceding example is selected respectively with 20 percent for the third to eighth rolling frames 1 or drawing passes, and in FIG. 1 is given underneath the respective rolling frame 1. Under the first and second rolling frames 1 it is indicated that the cross-section reduction Q there is steplessly changeable between zero and the maximum value of for example 20 percent. The lower cross-section reduction Q can be obtained in that the rollers are inserted in the greater radial distance from the longitudinal axis of the rolling products and as a result the rolling product 2 is reduced less as before. With a respective radial roller adjustment, it can be achieved that actually no rolling product reduction is performed and thereby the cross-section reduction Q is equal to zero. A lower cross-section reduction Q in the first rolling frame 1 or rolling pass leads however to a lower outlet speed of the rolling product 2 from this first rolling pass or to a lower inlet speed of the rolling product 2 in the subsequent second rolling pass. As a result, the roller rotary speeds must be adjusted there. Since the motors 3 and 4 are regulatable independently from one another as to their rotary speed, the ratio of the rolling rotary speeds between the first and the second rolling frames 1 can be changed steplessly and thereby adapt to the cross-section reduction Q which is desired in the first and second rolling frames 1 and adjusted by the roller displacement. Since to the contrary, in the third rolling frame 1 as well as in the subsequent rolling frames 1 with the drawing passes the cross-section reduction Q remains the same, there also the ratio of the roller rotary speeds can remain the same. In other words, fixed toothed wheel ratios can be utilized as shown in the main transmission 6.

The last rolling frames 1 at the outlet side differ in FIG. 1 by their different hatching from the front eight rolling frames 1 which contain the drawing passes. Therefore it can be clearly seen that the rear rolling frames 1 contain finishing passes. In order to produce a form-accurate rolling product 2 with narrow size tolerances and fine surface, the cross-section reduction Q in the finishing passes is selected lower than in the preceding drawing passes. Therefore and also due to the fact that in the finishing passes the rolling product 2 obtains its final cross-sectional shape, the finishing passes differ from the drawing passes. They are jointly driven in FIG. 1 by the rear motor 5. The motor 5 is also separately regulatable, so that an adjustment of all finishing passes to the prearranged drawing passes is possible. The finishing passes all have a fixed rotary number ratio, since they are driven through fixed toothed wheel transmission steps.

A switching transmission step 8 is arranged between the motor 5 and the main transmission 6 and has two speeds, while of course more speeds are advisable. With the switching transmission step 8 the motor 5 can always operate in a rotary speed region which is favorable for it, in particular with the roller rotary speeds required for the different cross-section reductions Q.

An eleventh rolling frame 1 is identified in FIG. 1 with dashed lines. It can be arranged in those cases when in particular narrow tolerances and especially high shape accuracy of the rolling product 2 are required. The eleventh rolling frame 1 is driven through a fixed toothed wheel ratio from the motor 5.

It is recommended that all fixed toothed wheel transmission steps be formed and determined with the calibration of the rollers, so that between all rolling frames 1 always a small pool be produced. This insures that no pressure is applied in the longitudinal direction on the rolling product 2 and an unobjectionable passage of the rolling product 2 is guaranteed.

Figure 2:
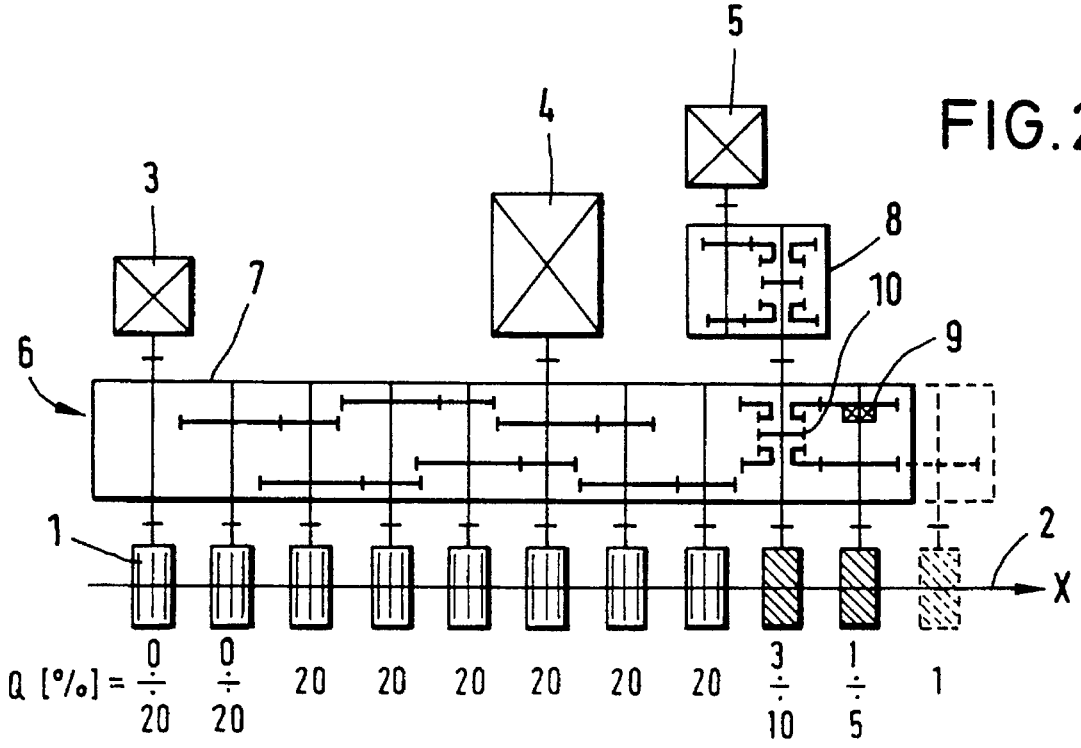
FIG. 2 is a schematic view showing a rolling block for rolling bars or wires in accordance with the present invention.

The embodiment of FIG. 2 differs from the embodiment of FIG. 1 in that the roller frames 1 are not assembled in pairs but instead have the same distances from one another. A second substantial difference is that a free running coupling 9 inside the transmission housing 7 of the main transmission 6 is arranged between the ninth and tenth roller frames 1. It is therefore possible that the rollers of the tenth rolling frame 1, and eventually also the eleventh rolling frames 1 run faster than they are driven from the motor 5. Their drive is performed through the rolling product 2. This is however possible only from a predetermined minimal cross-section of the rolling product 2. In this manner any pull in the region of the finishing pass of the last rolling frame 1 at the outlet side can be avoided and therefore also the disadvantages connected with it. For a small rolling product cross-sections, it is not achievable due to the danger of the latter bending of the rolling product 2. Therefore the free running coupling 9 is turned off by a switching device 10. With the switched-off free running coupling 9, simultaneously a fixed transmission step ratio is provided, which produces a light pull between the last rolling frames 1 at the outlet side.

Figure 3:
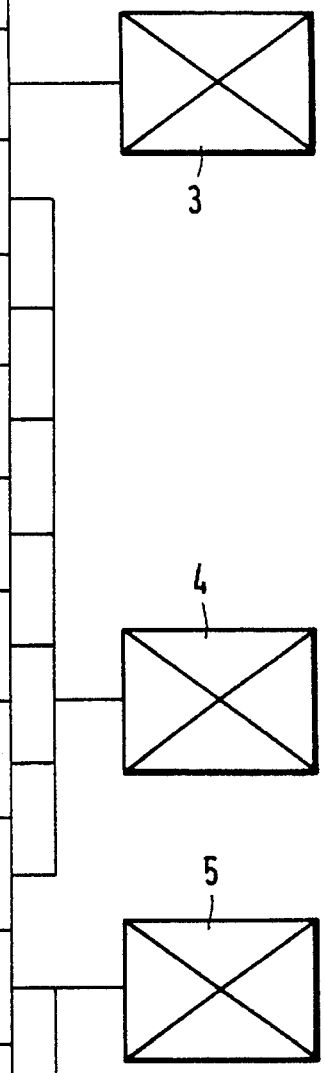
FIG. 3 is a pass diagram with flat drawing passes and rearwardly located free spots.

FIG. 3 shows in form of the table a pass diagram corresponding to FIGS. 1 and 2, without the eleventh rolling frame 1 which is only calibrating. In the second column at the right side near the rolling frame numbers the triangular shape and the gradually reducing cross-section of the pass openings in the first eight rolling frames 1 with their drawing passes is recognized, as well as the position of the working surfaces of the rollers and thereby their arrangement inside the rolling frame 1. Moreover, it is shown that the finishing passes in the ninth and tenth rolling frames have a substantially round cross-sectional shape and a smaller cross-section reduction Q than the drawing passes, with the numbers near all pass openings in FIG. 3 identifying the respective cross-section reductions Q in percentages.

For producing the smallest final diameter (FIG. 3, second column, last line) all available rolling frames 1 or passes are required. The rollers must first be again inserted and the pass openings be provided by adjustment and working of the rollers, as shown by the hatching of all pass openings in title second column. When it is necessary, starting for example from the same initial cross-section, a greater final diameter is to be produced as shown in FIG. 3 in three successive columns, and the additional drawing passes, for example in the third column the seventh and eighth rolling frame must be removed. In the case of third column, only the rollers in the finishing passes of the ninth and tenth rolling frames 1 must be post-worked or post-adjusted, while the rollers in the preceding six drawing passes must be adjusted only in the radial direction, so that here each post-working is dispensed with. In order to illustrate this, the pass openings of the latter mentioned six drawing passes in the third column are shown without hatching.

When greater finishing passes are desired, the same principle is applied. These cases are shown in the fourth and fifth column in FIG. 3. Further, in FIG. 3 it can be clearly seen that for greater final cross-sections, no longer required drawing passes are always removed in pairs. Therefore with the arrangement of the roller gaps, the alternating sequence remains and a turning of the remaining rolling frames is also avoided as well as the conversion of the same to other frame spots. With this removal or insertion of the neighboring drawing passes in pairs, the total cross-section reduction of the rolling block is changed by respectively two times 20 percent, or in other words by substantial amounts and moreover in stepped manner. Despite this, it is possible to form uninterruptedly all final cross-sections located in the working region of the rolling block, as shown in the lowermost line of FIG. 3. The reason is that the both first drawing passes on the frame spots 1 and 2 are changeable in their cross-section reductions Q respectively between zero and 20 percent, since there the rollers can be radially displaced in a corresponding manner and the separate regulation of the motors 3 and 4 can be provided for the required adjustment of the roller rotary speeds. The drawing calibers of the third to eighth rolling frames have also rollers which can be radially adjusted in sufficient manner. However the rotary speed ratios between the rolling frames cannot be changed, so that the rolling can be always performed with the same cross-section reduction Q of respectively, for example, 20 percent. Another cross-section reduction Q is not required in these drawing passes since the regulatable cross-section reductions Q in the both first rolling frames 1 can be completely sufficient, to produce uninterruptedly each final cross-section in the working region of the rolling block. In the third to eighth rolling frames the cross-section reductions Q in this example amounts to 20 percent and thereby they are identical. The latter is however not completely necessary, but instead these rolling frames 1 can be associated with different cross-section reductions Q. This must be however taken into consideration in the transmission steps of the main transmission 6 and requires a substantial expense.

Figure 4:
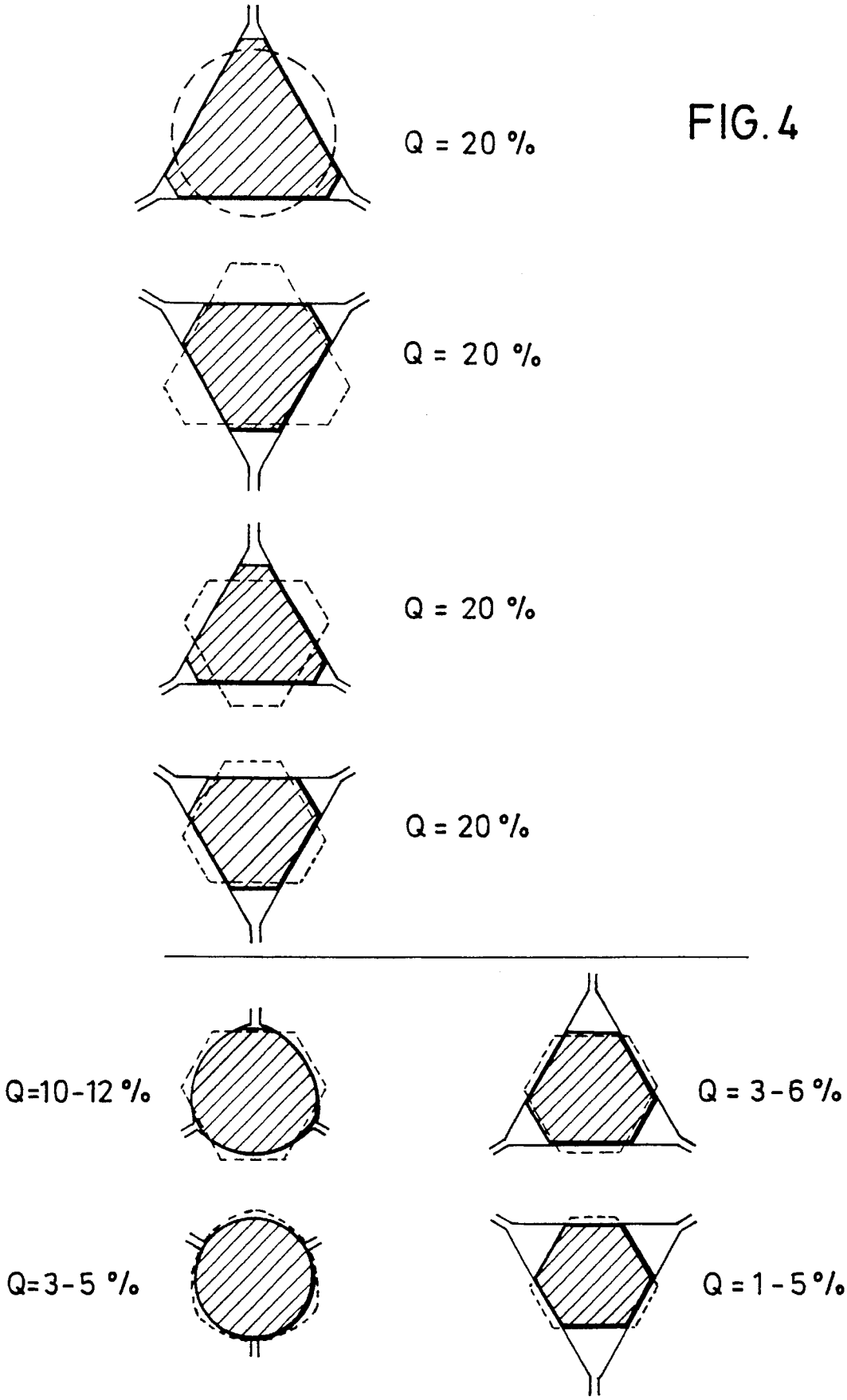
FIG. 4 is an example of a calibration with respect to the pass diagram of FIG. 3.

FIG. 4 shows in an upper part the first four pass openings of the rolling block of FIGS. 1–3, wherein also the both first passes at the inlet side are adjusted to their maximum cross-section reduction of approximately 20 percent. The respective cross-sections at the inlet side are shown with dashed lines. It can be seen that the starting cross-section at the inlet side at the first pass is circular and the following cross-sections at the inlet side respectively correspond to the outlet cross-section of the preceding pass, whereby this principle is completely illustrated. The remaining drawing passes of the fifth to eighth drawing frames 1 are removed in FIG. 4. Instead, the ninth and tenth rolling frames are shown at the left side under the finishing passes, and on an enlarged scale compared to the upper four drawing passes for clearly illustrating the respective cross-sections at the inlet side and the outlet side. The both left finishing passes produce a circular final cross-section in correspondence with FIG. 3, whereby the both right finishing passes produce an exact hexagonal cross-section as an alternative solution to FIG. 3. It is naturally also possible to provide the ninth and tenth of the rolling frames with flat passes as shown in FIG. 4 below at the right side. Here also near passes, the associated cross-section reductions Q are identified.

Figure 5:
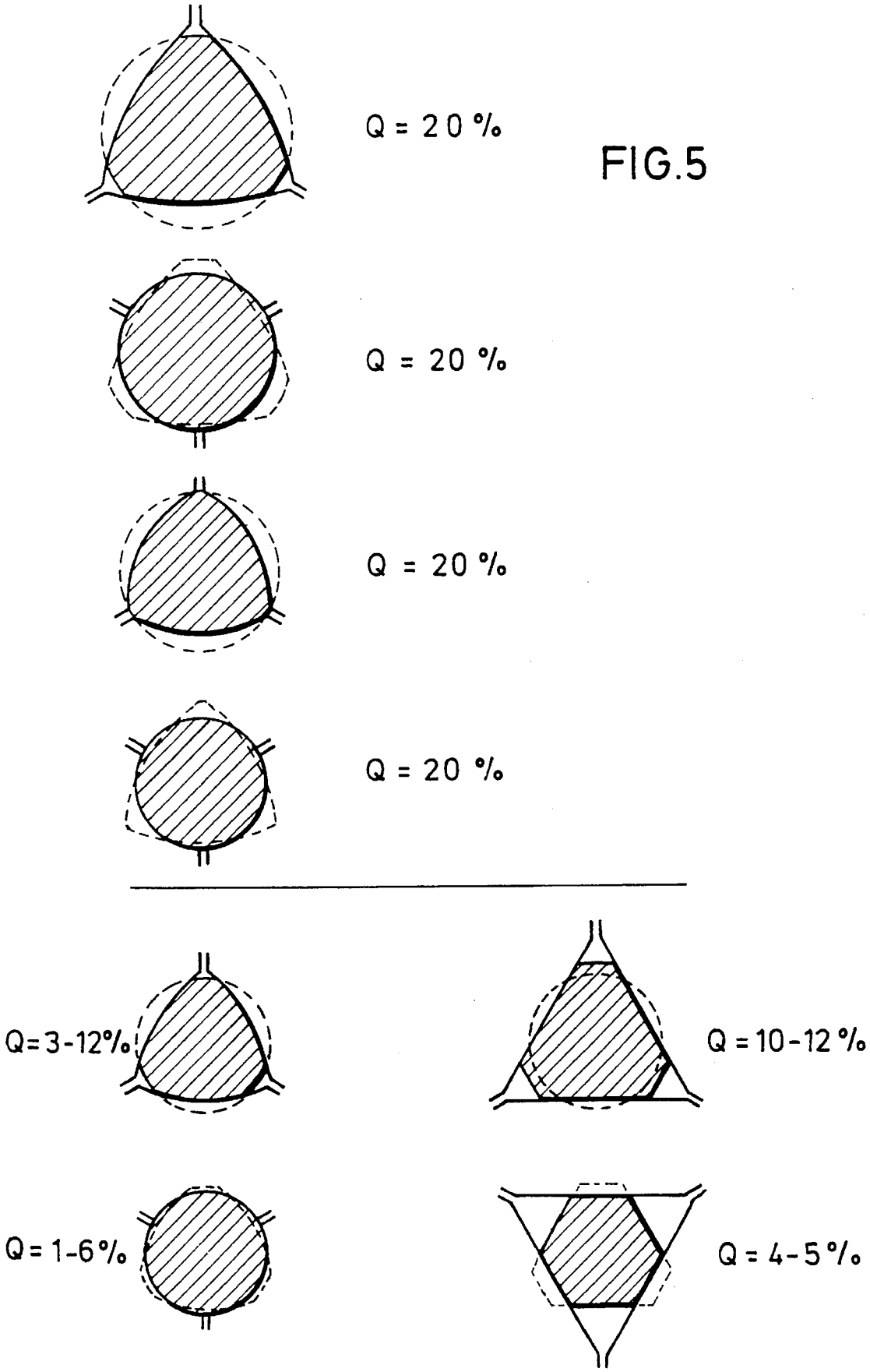
FIG. 5 is a view showing another example of calibration with respect to FIG. 3.

FIG. 5 substantially corresponds to FIG. 4, but has the difference that the first four drawing passes are not formed as flat passes, but instead as so-called oval-round passes. An oval pass always follows a round pass, whereby a comparable action is obtained as with the flat passes. As in FIG. 4, here also both round and hexagonal final sections can be produced and shown in FIG. 5 below two different types of finishing passes.

Figure 6:
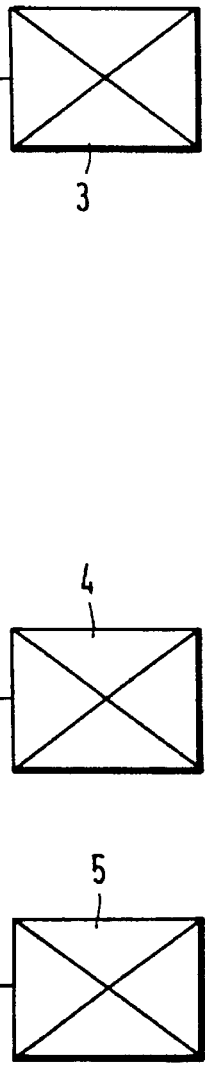
FIG. 6 is a view showing a pass diagram with flat drawing passes and forwardly located free spots.

FIG. 6 substantially corresponds to FIG. 3 since here also from an initial cross-section with a diameter of 79.5 mm, a final cross-section with diameters between 30 and 73.2 mm are rolled. The difference is, first of all, in that here another embodiment of the first inventive solution is illustrated in accordance with which the excessive drawing passes are removed from the front region of the drawing passes, and the rear drawing passes are retained in the rolling block or replaced by the previously withdrawn passes. Therefore here the first frame spot at the inlet side also remains occupied, but from the second frame spot to the outlet side empty frames or guides can be inserted. Therefore it is possible to adjust the respective second drawing passes as well as the first passes to a cross-section reduction Q between zero and, for example, 20 percent in a stepless manner. This leads to the same action as in FIG. 3. The total drive including the main transmission is formed in the embodiment of FIG. 6 as in the embodiment of FIG. 3.

Figure 7:
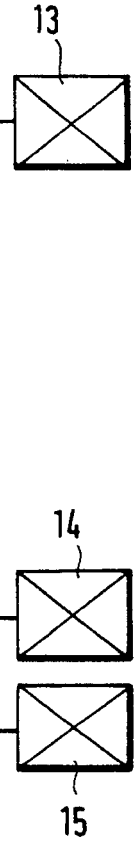
FIG. 7 is a view showing a pass diagram with a group drive at the inlet side and rearwardly located free spots.

FIG. 7 to the contrary shows pass diagram of the second inventive solution. It substantially corresponds to FIG. 3 as well. The difference in FIG. 7 and thereby the second solution resides in that the first frame spot at the inlet side is no longer driven by a separate motor 3. Instead a front motor 13 drives the first eight frame spots together. Moreover, the ninth and tenth frame spots in FIG. 7 are driven by separate motors 14 and 15. Since the rolling block in accordance with FIG. 7 is a preceding block or an intermediate block which has no finishing passes, all available rolling frames 1 are provided exclusively with drawing passes. While in FIG. 2 the both rolling frames at the inlet side are adjustable to the cross-section reductions Q between zero and a maximum value, in FIG. 7 both last calibers at the outlet side can be adjusted to the cross-section reductions Q between zero and a maximum value. This is achieved on the one hand by the radial displaceability of the rollers and first of all the drive by two separate regulatable motors 14 and 15, to change the rotary speed ratios in the region of the both last passes at the outlet side. Thereby also in the second solution as in the first solution it is possible to produce all outlet cross-sections which are located in the working region of this rolling block uninterruptedly from a single initial cross-section. It is performed by the adjustment of the intermediate dimensions of the first rolling frame 1 at the inlet side to the last rolling frame 1 at the outlet side.

In this second inventive solution when greater outlet cross-sections are desired, some drawing passes are superficial and can be removed from the rolling block. As in FIG. 3, an even number of empty frame spots before the penultimate frame spot are produced as can be seen in FIG. 7. Therefore, first of all it is possible to remove for example the rolling frames 1 or passes from the frame spots 7 and 8 and to spread rollers of the pass on the ninth and tenth frame spots from one another in a radial direction, for adjusting the same to the greater rolling product cross-section. When the displaceability or the width of the working surfaces in the rollers on the ninth and tenth frame spots is not sufficient to form the required great pass opening, it is possible to first remove the rolling frames 1 at the ninth and tenth frame spots and to replace them by respective rolling frames 1 which were located at the seventh and eighth frame spots. The latter are already provided with a pass opening with a greater cross-section. Here also the frame spots before the penultimate frame spot up to the frame spots at the inlet side remain free, in correspondence with the illustration of FIG. 7, wherein the encircled pass numbers 1 to 10 illustrate the remaining individual passes or rolling frames 1. In the last mentioned type of conversion, in addition to the removal of both last rolling frames 1, two rolling frames 1 at another frame spots must be converted, however, only two, and they must not be turned in a complicated manner. The remaining rolling frames remain at the same frame spots and their rollers must not be displaced, so that the expense for the conversion as compared with conventional constructions is substantially reduced.

FIG. 7 moreover shows that during introduction of the corresponding cross-section reductions Q they must not be necessarily identical, but can have different values, as is true also for the embodiment of FIG. 3. To the contrary, in the embodiment of FIG. 7 the same cross-section reductions Q can be selected. What is important is only that in the embodiment of FIG. 3, the both first passes at the inlet side and in the embodiment of FIG. 7 the both last passes at the outlet side are steplessly adjustable to different cross-section reductions between zero and a maximum value.

It will be understood that each of the elements described above, or two or more together, may also find a useful application in other types of constructions differing from the types described above.

While the invention has been illustrated and described as embodied in a rolling block for rolling metallic bars or wires, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A rolling block for rolling metallic bars or wires, comprising a plurality of successive frame spots; a plurality of rolling frames arranged on said frame spots and each having three rollers arranged in a star-like manner and radially adjustable with respect to a longitudinal axis of a rolling product; driving means for driving said rollers and including separately regulatable motors with a front motor, at least one central motor, and at least one rear motor, said rolling frames including less rolling frames than said frame spots, said rolling frames including rolling frames provided with finishing passes and all located always at an outlet side and driven by said at least one rear motor, a first one of said rolling frames provided with drawing passes being always located at a first frame spot provided at an inlet side and also driven by said front motor, and all remaining rolling frames provided with drawing passes being located at frame spots which immediately follow said first frame spot and at frame spots immediately preceding said rolling frames with finishing passes and driven by said at least one central motor.

2. A rolling block as defined in claim 1, wherein said rolling frames are formed so that a cross-section reduction of the rolling product is changeable in first drawing passes at the inlet side steplessly between zero and a maximum percentage value, while in all remaining drawing passes it is constant.

3. A rolling block as defined in claim 1; and further comprising a main transmission provided between said rolling frames with drawing passes and said at least one central motor, said main transmission having fixed gear wheel ratios.

4. A rolling block as defined in claim 1, wherein said rolling frames and said frame spots are arranged so that an even number of said rolling frames with drawing passes are removed and do not occupy respective frame spots.

5. A rolling block as defined in claim 1, wherein each of said drawing passes is formed of rollers with cylindrical working surfaces.

6. A rolling block as defined in claim 1, wherein each of said drawing passes is formed of rollers with working surfaces which are concavely curved in a cross-section, while test openings of said drawing passes are alternatingly oval and round.

7. A rolling block as defined in claim 1, wherein in a first one of said finishing passes working surfaces of said rollers are maximum 0.63 times and in at least one subsequent finishing pass working surfaces of said rollers are maximum 0.55 times of a final diameter of the rolling product and are concavely curved in a cross-section.

8. A rolling block as defined in claim 1; and further comprising a third additional finishing pass provided with a calculated cross-section reduction of approximately 1 percent and arranged behind a last one of said frame spots at the outlet side.

9. A rolling block as defined in claim 1, wherein said driving means is formed so that a drive for a second one of said finishing passes has a free running for allowing a higher through speed of the rolling product than other passes.

10. A rolling block as defined in claim 1; and further comprising a switching transmission step provided with at least two speeds and arranged between said rear motor and a finishing pass which is driven by said rear motor.

11. A rolling block as defined in claim 2, wherein said rolling frames are formed so that the cross-section reductions in said remaining drawing passes are equal and correspond to the maximum value.

12. A rolling block as defined in claim 9, wherein said driving means include a drive for a third one of said finishing passes which also has a free running for allowing a higher through speed of the rolling product than other passes.

13. A rolling block as defined in claim 9, wherein said free running is selectively turnable on and turnable off; and further comprising means for selectively turning on and off said free running.

14. A rolling block for rolling metal bars or wires, comprising a plurality of successive frame spots; a plurality of rolling frames arranged at said frame spots and each having three rollers arranged in a star-like fashion and displaceable radially relative to a longitudinal axis of a rolling product; and driving means for driving said rollers and including separate motors, said rolling frames including less rolling frames than said frame spots, a last one and a penultimate one of said frame spots at an outlet side being always provided with said rolling frames which are separately driven, while all remaining rolling frames at first frame spots at an inlet side being arranged directly one after the other and said rollers of passes of said remaining rolling frames being driven by at least one separate front motor.

15. A rolling block as defined in claim 14, wherein for converting to a substantially greater outlet cross-sectional surface of the rolling product, said rolling frames at both last frame spots at the outlet side are removed and replaced by both rearmost remaining roller frames of front frame spots.

16. A rolling block as defined in claim 14, wherein said roller frames are formed so that only in two last passes at the outlet side a cross-section reduction of the rolling product is changeable steplessly between zero and a maximum percentage value, while in all remaining passes it is constant.

17. A rolling block as defined in claim 14; and further comprising a main transmission provided between said rolling frames and said front motor and having fixed toothed wheel transmission ratios.

18. A rolling block as defined in claim 14, wherein said rolling frames and said frame spots are formed so that an even number of said rolling frames is removed and do not occupy respective frame spots.

19. A rolling block as defined in claim 14, wherein all said rollers have cylindrical working surfaces.

20. A rolling block as defined in claim 16, wherein said rolling frames are formed so that cross-section reductions in said all remaining passes are identical and correspond to the maximum percentage value.

21. A rolling block for rolling metallic bars or wires, comprising a plurality of successive frame spots; a plurality of rolling frames arranged on said frame spots and each having three rollers arranged in a star-like manner and radially adjustable with respect to a longitudinal axis of a rolling product; driving means for driving said rollers and including separately regulatable motors with a front motor, at least one central motor, and at least one rear motor, said rolling frames including less rolling frames than said frame spots, said rolling frames including rolling frames provided with finishing passes and all located always at an outlet side and driven by said at least one rear motor, a first one of said rolling frames provided with drawing passes being always located at a first frame spot provided at an inlet side and also driven by said front motor, and all remaining rolling frames provided with drawing passes being located at frame spots selected from the group consisting of frame spots which immediately follow said first frame spot and frame spots immediately preceding said rolling frames with finishing passes and driven by said at least one central motor, said rolling frames and said passes being formed so that a cross-section reduction of the rolling product performed in two passes is staplessly adjustable between zero and a maximum percentage value.

22. A rolling block for rolling metal bars or wires, comprising a plurality of successive frame spots; a plurality of rolling frames arranged at said frame spots and each having three rollers arranged in a star-like fashion and displaceable radially relative to a longitudinal axis of a rolling product; and driving means for driving said rollers and including separate motors, said rolling frames including less rolling frames than said frame spots, a last one and a penultimate one of said frame spots at an outlet side being always provided with said rolling frames which are separately driven, while all remaining rolling frames at first frame spots at an inlet side being arranged directly one after the other and said rollers of passes of said remaining rolling frames being driven by at least one separate front motor, said rolling frames and said passes being formed so that a cross-section reduction of the rolling product performed in two passes is steplessly adjustable between zero and a maximum percentage value.

* * * * *